US007832896B2

(12) United States Patent
Saha et al.

(10) Patent No.: US 7,832,896 B2
(45) Date of Patent: Nov. 16, 2010

(54) LED LIGHT ENGINE

(75) Inventors: Koushik Saha, Brunswick, OH (US); Jeffrey Nall, Brecksville, OH (US); Mark J. Mayer, Sagamore Hills, OH (US); Chunmei Gao, Pudong (CN); Kevin Carpenter, Shaker Heights, OH (US); Shanshan Xie, ShangHai (CN); Yiyu Cao, ShangHai (CN); John Owens, Olmsted Falls, OH (US)

(73) Assignee: Lumination LLC, Valley View, OH (US)

( * ) Notice: Subject to any disclaimer, the term of this patent is extended or adjusted under 35 U.S.C. 154(b) by 284 days.

(21) Appl. No.: 12/105,963

(22) Filed: Apr. 18, 2008

(65) Prior Publication Data

US 2009/0262531 A1 Oct. 22, 2009

(51) Int. Cl.
*F21V 1/00* (2006.01)

(52) U.S. Cl. ..... 362/240; 362/217.05; 362/237; 362/241; 362/244; 362/249.02; 362/296.01

(58) Field of Classification Search ..... 362/217.01–217.02, 217.05, 219, 223, 225, 362/227, 235–237, 240–241, 244–247, 249.02, 362/296.01–296.03, 307–308, 310, 311.01–311.05, 362/335

See application file for complete search history.

(56) References Cited

U.S. PATENT DOCUMENTS

| | | | | |
|---|---|---|---|---|
| 5,559,681 | A | 9/1996 | Duarte | |
| 5,577,493 | A | 11/1996 | Parkyn, Jr. et al. | |
| 6,074,074 | A * | 6/2000 | Marcus | 362/240 |
| 6,566,824 | B2 | 5/2003 | Panagotacos et al. | |
| 6,673,292 | B1 | 1/2004 | Gustafson et al. | |
| 6,673,293 | B1 | 1/2004 | Mistopoulos et al. | |
| 6,837,598 | B2 * | 1/2005 | Marcus | 362/374 |
| 6,924,973 | B2 | 8/2005 | Kim | |
| 6,942,360 | B2 | 9/2005 | Chou et al. | |
| 7,160,140 | B1 | 1/2007 | Mrakovich et al. | |
| 7,165,863 | B1 | 1/2007 | Thomas et al. | |
| 2004/0075399 | A1 | 4/2004 | Hall | |
| 2006/0187668 | A1 | 8/2006 | Howe | |
| 2006/0270105 | A1 | 11/2006 | Takiar et al. | |

* cited by examiner

*Primary Examiner*—Stephen F Husar
*Assistant Examiner*—Meghan K Dunwiddie
(74) *Attorney, Agent, or Firm*—Fay Sharpe LLP

(57) ABSTRACT

A light engine comprises a plurality of LEDs and a plurality of optical elements each cooperating with a respective LED. The optical elements broaden the off-axis angle from the respective LEDs to provide a more uniform illumination at a target plane.

21 Claims, 6 Drawing Sheets

LED LIGHT ENGINE

BACKGROUND

LED light engines are used to illuminate box and channel letter signs. In the United States of America a typical channel letter sign has a five inch can depth, which is the distance between the rear wall and the translucent cover of the channel letter. To illuminate the channel letter, an LED string light engine attaches to the rear wall and directs light forwardly towards the translucent cover. To optimize efficiency, the LEDs are spaced as far from one another as possible before any dark spots and/or overly bright spots are noticeable on the translucent cover. To minimize dark spots, the LEDs are spaced close enough to one another so that the light beam pattern from each LED overlaps the light beam pattern from adjacent LEDs by a defined amount in order to achieve a uniform appearance to the observer of the sign.

FIG. 1 depicts a schematic representation where a first LED 10 is spaced a distance (center-to-center) W from an adjacent second LED 12 in a sign 14. In this schematic representation, the LEDs 10 and 12 attach to a rear wall 16 of the sign and direct light towards a translucent cover (a typical sign only include one cover, but this schematic depiction shows two covers each at a different distance from the LEDs for illustration purposes). A first illustrative translucent cover 18 is spaced a distance D1 from the LEDs and a second illustrative translucent cover 20 is spaced a distance D2 from the LEDs, where D1 is greater than D2.

The distance W is referred to as a stroke width, which is the distance between adjacent strips, or rows, of LED light engines in the sign or channel letter. The stroke width W is a function of the LEDs' viewing angle. The LED viewing angle $\Theta$ is twice the off-axis angle $\beta$ defined by the boundary at a plane where the LED's luminous intensity is some percentage of the intensity at the direct, on-axis view normal to the plane. It is desirable to space the LEDs such that the 50% intensity boundary from the first LED 10 overlaps, coincides with or is in close proximity to the 50% intensity boundary of the second LED 12. In this fashion the 50% intensities from each LED add to about 100% of the on-axis intensity for a single LED. If this relationship is maintained throughout the sign, a desired uniformity is achieved resulting in no noticeable bright spots or dark spots on the translucent cover.

Channel letters are also manufactured having a shallower can depth, some as small as one inch. For a can depth of five inches (125 mm) and a stroke width W, the viewing angle $\Theta$ required for the 50% boundary to coincide with the 50% boundary of the adjacent LED is much narrower than the viewing angle $\Theta$ required for the 50% boundary to coincide with the 50% boundary of the adjacent LED for a one inch can depth, where the stroke width W remains the same. This is because the tan $\beta$ is directly proportional to the stroke width W and inversely proportional to the can depth. This is represented with reference back to FIG. 1, where it shown that the viewing angle $\Theta$ for the LEDs is appropriate for a sign where the LEDs are spaced D1 from the translucent cover. In contrast, the viewing angle is too narrow for a sign where the LEDs are spaced D2 from the translucent cover, where the spacing W remains the same between the LEDs.

Known LED light engines used to illuminate channel letters having shallower can depths (typically less than two inches) require the LEDs to be spaced very close to one another, i.e. decrease the stroke width W, to provide the desired beam pattern overlap that was discussed above. These LED systems require many LEDs to illuminate the channel letter since the LEDs must be spaced so closely together. This results in inefficiencies with regard to energy usage as well as higher costs since the LED is typically the most expensive component of the light engine.

SUMMARY

A light engine for illuminating a target plane at a defined uniformity that overcomes the aforementioned shortcomings includes a plurality of LEDs and a plurality of optical elements each cooperating with a respective LED. The light engine is spaced from the target plane a distance D. The LEDs are arranged in adjacent rows spaced from one another by a distance W. Each of the LEDs has an off-axis angle $\beta$1 defined by a half intensity boundary where luminous intensity of the LED on a plane is about half the luminous intensity on the plane at the direct on-axis view, and tan $\beta$1<(W/2)/D. The optical elements broaden the off-axis angle $\beta$1 to an off-axis angle $\beta$2 wherein the half intensity boundary of one row of LEDs is in close proximity to the half intensity boundary of the adjacent row of LEDs at the target plane. Using such a light engine, the defined uniformity of illumination at the target plane can be substantially maintained.

A method for illuminating sign that overcomes the aforementioned shortcomings includes placing a plurality of electrically interconnected LED modules in a sign having a translucent cover, spacing each LED a distance D from the translucent cover, arranging the LEDs in adjacent rows such that adjacent LEDs are spaced from one another a distance W, and illuminating the plurality of LEDs to generate a plurality of beam patterns on the translucent cover. Each LED module can include an LED and an optical element cooperating with the LED. Each LED has an off-axis angle $\beta$1 where luminous intensity of light emanating from the respective LED that is not redirected by the respective optical element is about half the luminous intensity of on-axis luminous intensity for the respective LED. The LED modules are arranged in adjacent rows such that adjacent LEDs are spaced from one another the distance W, wherein tan $\beta$1<(W/2)/D. Illuminating the plurality of LEDs further includes redirecting light from each LED via the respective optical element to have an off-axis angle $\beta$2 where luminous intensity of light emanating from the respective LED that is redirected by the respective optical element is about half the luminous intensity of on-axis luminous intensity for the respective LED and the respective optical element. In this method, a first altered beam pattern on the target plane generated by the first LED in combination with a first optical element in the first row and bounded by the off-axis angle $\beta$2 for the first LED and the first optical element overlaps a second altered beam pattern on the target plane generated by the second LED in combination with a second optical element in the adjacent row and bounded by the off-axis angle $\beta$2 for the second LED and a second optical element.

In another embodiment, a light engine that overcomes the aforementioned shortcomings includes a plurality of electrically interconnected LED modules. The LED modules include a support having circuitry on a first surface, an LED on the first surface of the support and electrically connected to the circuitry, a substantially dome-shaped refractive optical element covering the LED, and an overmolded housing substantially surrounding the support and contacting the optical element to seal the LED protecting the LED from ambient. The LED can have a primary viewing angle. The optical element can be configured to increase the primary viewing angle of the LED to provide an altered viewing angle that is greater that the primary viewing angle.

In yet another embodiment, a light engine for illuminating a target plane at a defined uniformity that overcomes the aforementioned shortcomings includes a plurality of LEDs and a plurality of optical elements each cooperating with a respective LED. The light engine is spaced from the target plane a distance D. The LEDs are arranged in adjacent rows spaced from one another by a distance W. Each of the LEDs has an off-axis angle β1 defined by a half intensity boundary where luminous intensity of the LED on a plane is about half the luminous intensity on the plane at the direct on-axis view, and tan β1<(W/2)/D. The optical elements each cooperate with a respective LED to broaden the off-axis angle β1 to an off-axis angle β2 wherein tan β1 is about (W/2)/D.

DETAILED DESCRIPTION

Figure 2:
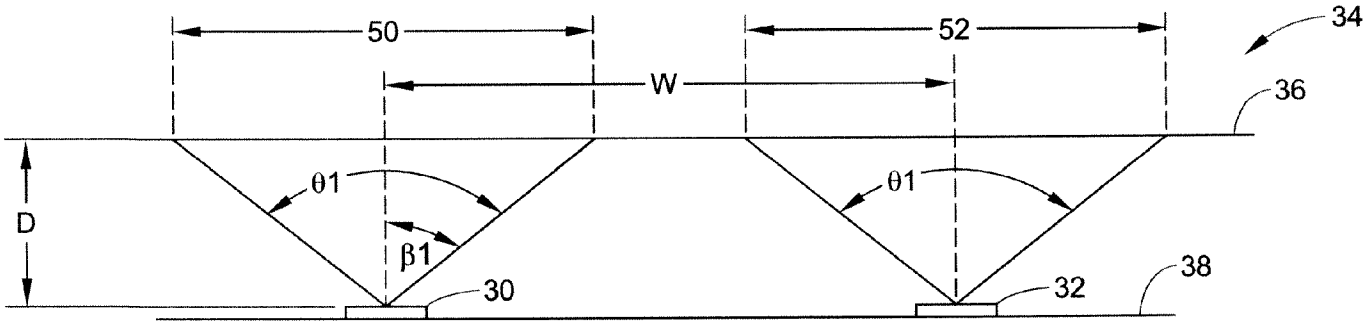
FIG. 2 is a schematic cross-sectional depiction of LEDs disposed in a sign and arranged in adjacent rows spaced from one another by a distance W.

FIG. 2 depicts a light engine for illuminating a target plane. More specifically, FIG. 2 depicts a light engine including a plurality of LEDs. A first LED 30 and a second LED 32 are shown in FIG. 2. The first LED 30 is spaced a distance W from the second LED 32. The first LED 30 and the second LED 32 can be one of many LEDs spaced from a target plane. When the light engine is used to illuminate a sign 34 the target plane can be a translucent cover 36 of the sign. The LEDs 30 and 32 are spaced a distance D from the translucent cover. The LEDs 30 and 32 are arranged in adjacent rows spaced from one another by a distance W. In other words, a row of electrically interconnected LEDs that includes the first LED 30 can continue in a direction normal to the plane in which the cross-section of FIG. 2 is taken. Similarly, a row of electrically interconnected LEDs that includes the LED 32 can also extend in the same direction.

Figure 10:
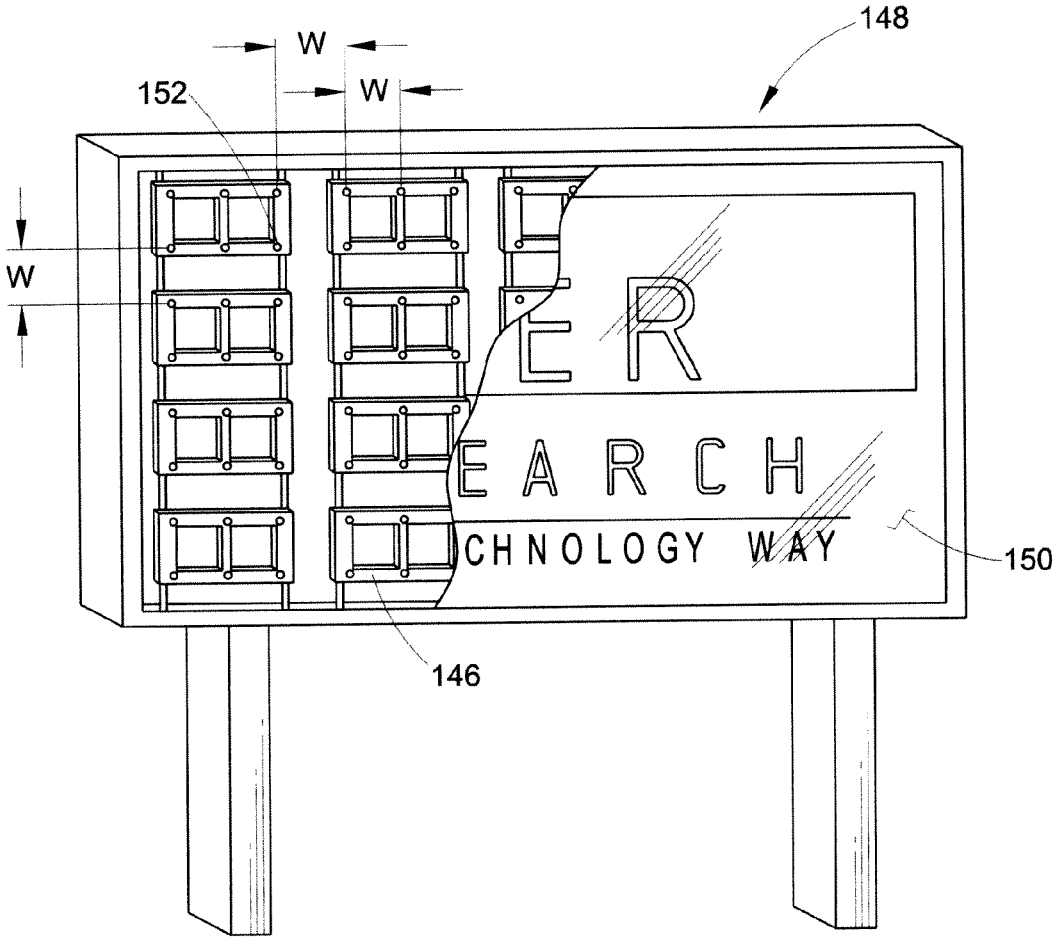
FIG. 10 is a front perspective view of a sign with a translucent cover partially broken away to show a light engine for the sign.

FIG. 10 shows a plurality of LED modules 146 in a sign 148 having a translucent panel 150. The LED modules are arranged in rows where the LEDs 152 are arranged in adjacent rows spaced from one another by a distance W. FIG. 10 provides an example of an LED light engine arranged in a sign to illuminate the sign that is similar to FIG. 2. The LEDs 152 shown in FIG. 10 can be the same as and/or operate the same as the LEDs 30 and 32 that are depicted schematically in FIG. 2.

With reference back to FIG. 2, each of the LEDs 30 and 32 (and the other LEDs in the respective rows) has a primary viewing angle Θ. The primary viewing angle Θ is the viewing angle for the LED without an optical element cooperating with each LED such as described below. For the sign 34 depicted in FIG. 2, the LEDs 30 and 32 are attached to a rear wall 38 of the sign 34 and direct light towards a target plane on the translucent cover 36.

With continued reference to FIG. 2, where the LEDs 30 and 32 are spaced from the target plane, which is the translucent cover 36 in this example, a distance D measured normal to the target plane and are arranged in adjacent rows spaced from one another by a distance W, the 50% intensity boundaries generated by the LEDs 30 and 32 do not overlap, coincide and are not in close proximity to each other. The first LED 30 generates a first primary beam pattern 50 and the second LED 32 generates a second primary beam pattern 52. The beam patterns 50 and 52 that are generated on the target plane are bounded by the off-axis angle β1, which is Θ½. The beam patterns 50 and 52 are generally circular being the base of a cone having a cone angle Θ1 and a vertex at the respective LED. Accordingly, tan β1<(W/2)/D. In this example, the light intensity at the target plane would not be uniform due to the darker areas between the adjacent patterns. The uniformity could be improved as in the prior art systems by decreasing the distance W until the 50% boundaries coincide. This of course requires more LEDs to cover the same area leading to higher cost and lower energy efficiency.

Figure 3:
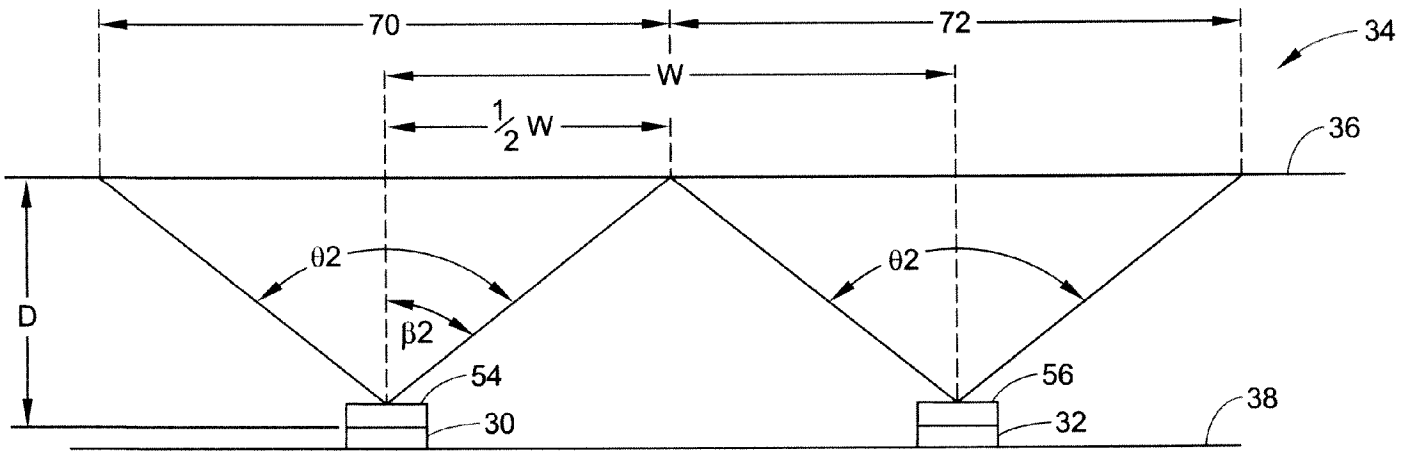
FIG. 3 is a schematic cross-sectional depiction of a plurality of LEDs and respective optical elements cooperating with the LEDs where the LEDs are disposed in a sign and arranged in adjacent rows spaced from one another by a distance W.

FIG. 3 depicts the same LEDs 30 and 32 disposed in the same sign 34 where the LEDs are spaced the same distance D from the same translucent cover 36. The LEDs 30 and 32 mount to the rear surface 38 of the sign 34 and direct light forwardly toward the translucent cover 36, which makes up the target plane. The LEDs 30 and 32 each comprise an LED in a respective row of LEDs spaced from one another by the distance W, which is the same as in FIG. 2.

In contrast to FIG. 2, a plurality of optical elements, for example optical element 54 and optical element 56, each cooperate with a respective LED to broaden the off-axis angle β1 in FIG. 2 to an off-axis angle β2. The optical elements redirect light from the respective LED such that the boundary where the LEDs luminous intensity is one-half the intensity at the direct, on-axis view is widened from that of the LED alone. In other words, the optical element 50 cooperates with the LED 30 to widen the beam pattern generated on the translucent panel 36 as compared to having no optical element cooperating with the LED 30. Similarly, the optical element 56 cooperates with the LED 32 to widen the viewing angle to provide a beam pattern that is wider than if the LED were to direct light toward the translucent panel without the optical element.

Where the plurality of LEDs, e.g., LED 30 and LED 32, are spaced from the target plane (translucent panel 36) the distance D, which is the same as FIG. 2, and are arranged in adjacent rows spaced from one another by the distance W, which is also the same as in FIG. 2, a first altered beam pattern 70 is generated by the first LED 30 in combination with the first optical element 54 and second altered beam pattern 72 is generated by the second LED 32 in combination with the second optical element 56. The first altered beam pattern 70 is bounded by the off-axis angle β2 for the first LED 30 and the first optical element 54. The second altered beam pattern 72 is also bounded by the off-axis angle β2 for the second LED 32 and the second optical element 56. The off-axis angle β2, similar to the off-axis angle β1, is where the luminous intensity of light emanating from the respective LED and redirected by the respective optic is about half the luminous intensity of the on-axis luminous intensity for the respective LED in combination with the respective optical element.

As seen in FIG. 3, the first beam pattern 70, which is generally circular, overlaps, at least partially coincides with, or is in close proximity to the second altered beam pattern 72. Accordingly, tan β2 is about equal to (W/2)/D, i.e., ±30%, more preferably ±20%, and more preferably ±10%. Since the off-axis angle β2 for the first LED 30 in combination with the first optical element 54 is about half the luminous intensity of the on-axis luminous intensity and the off-axis angle β2 for the second LED 32 and the second optical element 56 is about half the luminous intensity of the on-axis luminous intensity, where the beam patterns 70 and 72 coincide or overlap, the illumination at this location should be substantially the same as the illumination directly on axis for each respective LED and optical element combination. Accordingly, by providing the optical elements 54 and 56, the spacing W can be maintained for LEDs offset from the target plane a distance D. In other words, fewer LEDs can be used to provide a substantially uniform illumination on the target plane 36. The viewing angles need not be exactly to 50% luminous intensity.

Figure 1:
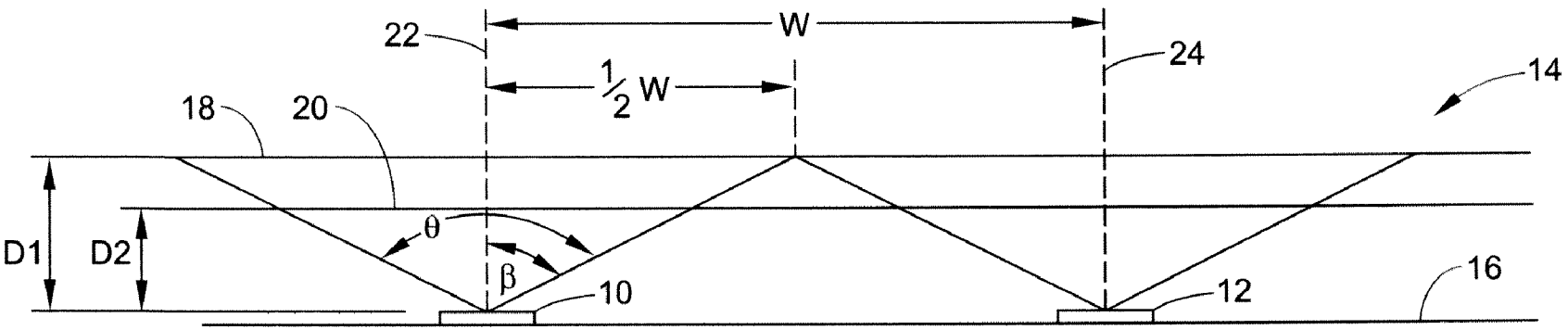
FIG. 1 (PRIOR ART)
FIG. 1 is a schematic cross-sectional representation of LEDs disposed in a sign and arranged in adjacent rows spaced from one another by a distance W.
Figure 4:
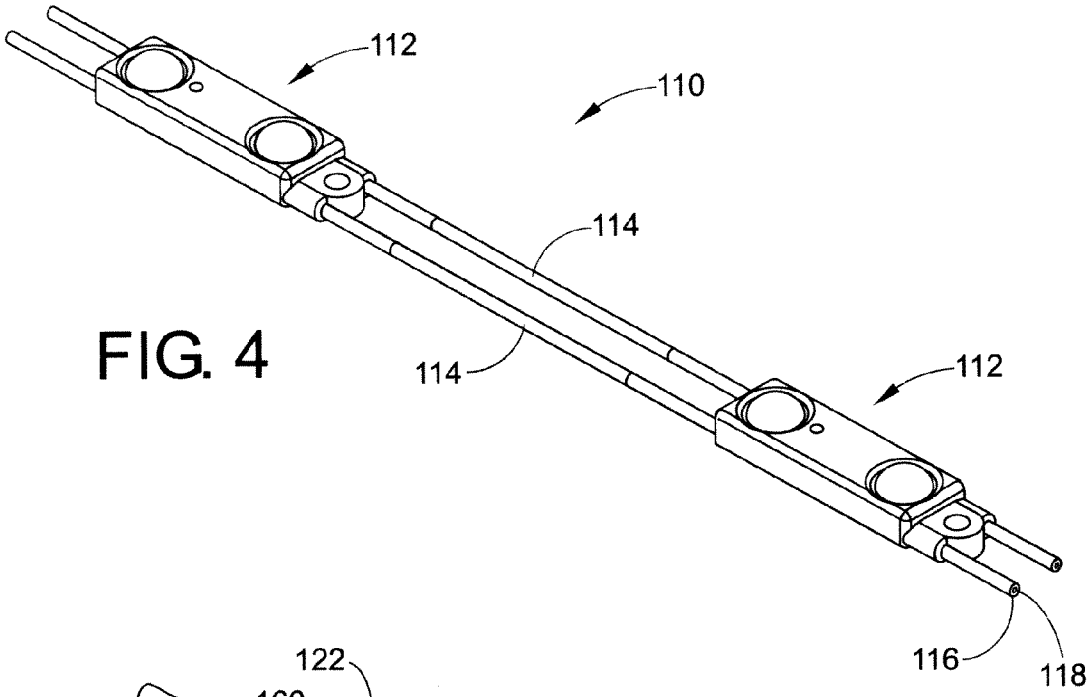
FIG. 4 is a perspective view of a string light engine for illuminating a sign such as the one schematically depicted in FIG. 3.

With reference to FIG. 4, a flexible LED string light engine 110 that can operate as a light engine for the sign 34 shown in FIG. 3 generally includes a plurality of LED modules 112 electrically interconnected by at least one flexible electrical conductor 114 (two electrical conductors are shown in FIG. 1). The electrical conductor 114 in the depicted embodiment includes insulation 116 that surrounds wires 118. The string light engine 110 is flexible so that it can be bent and shaped into many desirable configurations so that the string light engine can be placed inside the sign 34, which can take the form of a box sign or channel letter. FIG. 4 depicts only a portion of the light engine, which can extend along a much greater distance than depicted in FIG. 4. The string light engine 110 can be manufactured to have the length of many feet or meters long.

Figure 5:
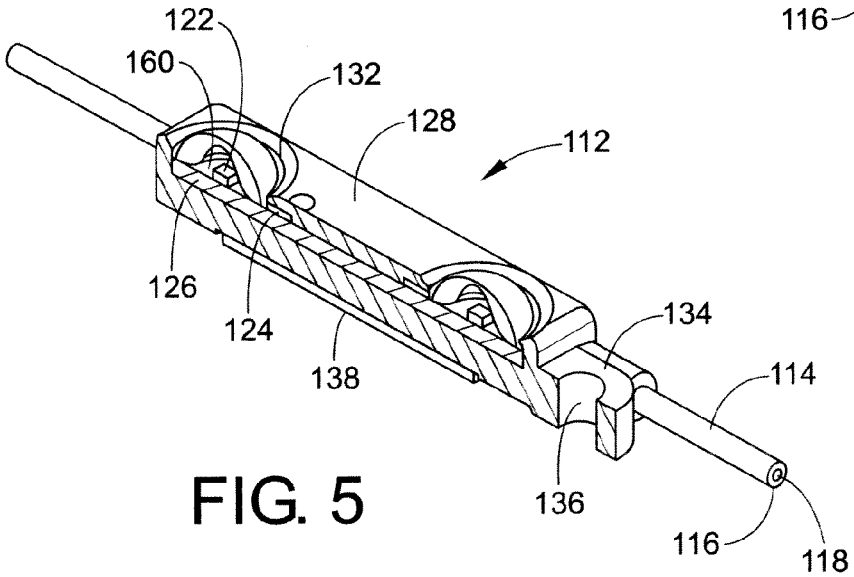
FIG. 5 is a cross-sectional view of an LED module of the string light engine of FIG. 4 taken along the center of the string light engine in an x-y plane.

With reference to FIG. 5, each LED module includes at least one LED 122 (two are shown for each module 112 in the depicted embodiment) and at least one optical element 124 cooperating with the LED. The LEDs 122 function similar to the LEDs 30 and 32 depicted schematically in FIG. 4. In other words the LEDs have a primary viewing angle Θ1 (see FIG. 2) when light from the LED is not being redirected by the optical element 124.

Each LED module 112 also includes a support 126, which in the depicted embodiment is a printed circuit board (PCB), having circuitry (not shown) on a first surface. The LEDs 122 are on the first surface of the support and are electrically connected to the circuitry in a conventional manner. The wires 118 of the flexible electrical conductor 114 attach to the PCB 126 in a conventional manner so that electrical energy can be supplied to the LEDs 122.

A housing 128 is provided with each LED module 112 to protect circuitry disposed on the PCB 126 and to mechanically attach the optical element 124 with relation to the PCB 126 so that the optical element can cooperate with the LEDs 122 in a manner that will be described in more detail below. In the depicted embodiment, the housing 128 is an overmolded housing that at least substantially surrounds each support 126 and a portion of the flexible electrical conductors 114 adjacent each support. The overmolded housing is more particularly described in U.S. Pat. No. 7,160,140. The housing 128 also contacts the optical element to seal the LED 122 protecting the LED from ambient. The housing 128 includes openings 132 through which a portion of the optical element 124 extends. Each housing 128 also includes a mounting element 134 including an opening 136 that is configured to receive a fastener for attaching the string light engine 110 to a desired surface. In the depicted embodiment, another means for attaching the string light engine 110 to a desired surface such as double-sided tape 138 attached to a lower surface of the overmolded housing 128 is also provided.

Figure 6:
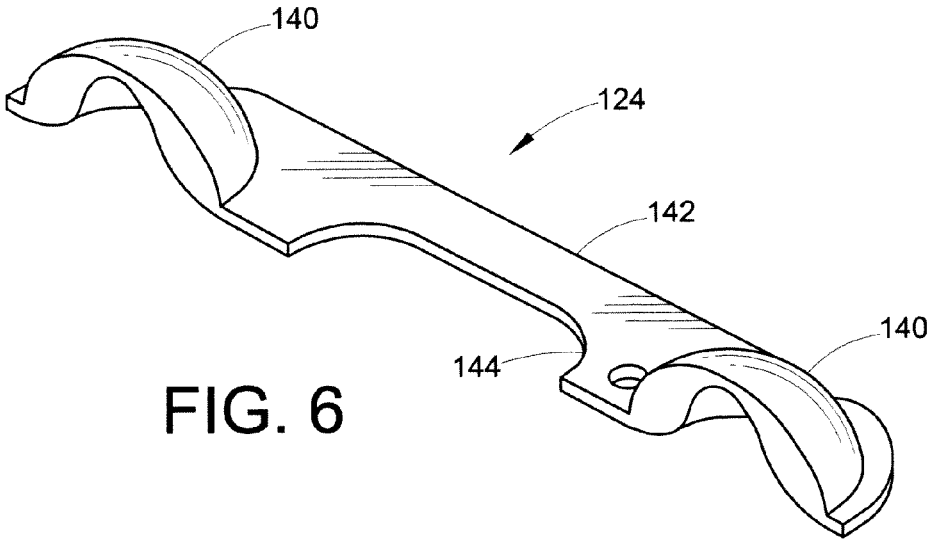
FIG. 6 is cross-sectional view of an optical element of the string light engine of FIG. 4 shown in cross-section taken through the center of the optical element in the x-y plane.
Figure 7:
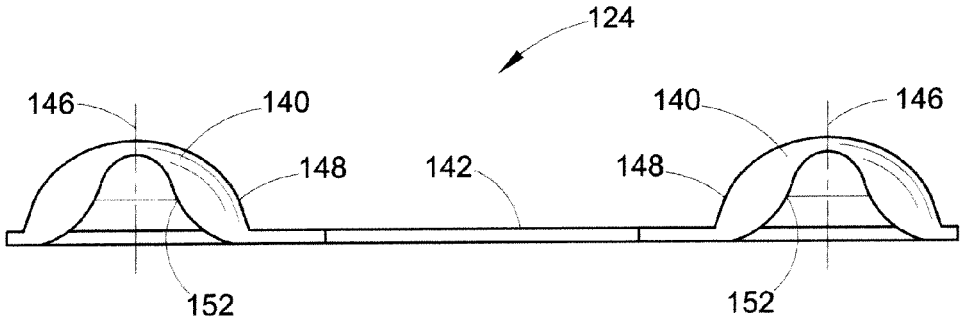
FIG. 7 is the cross-sectional view of FIG. 6 shown in side elevation.
Figure 8:
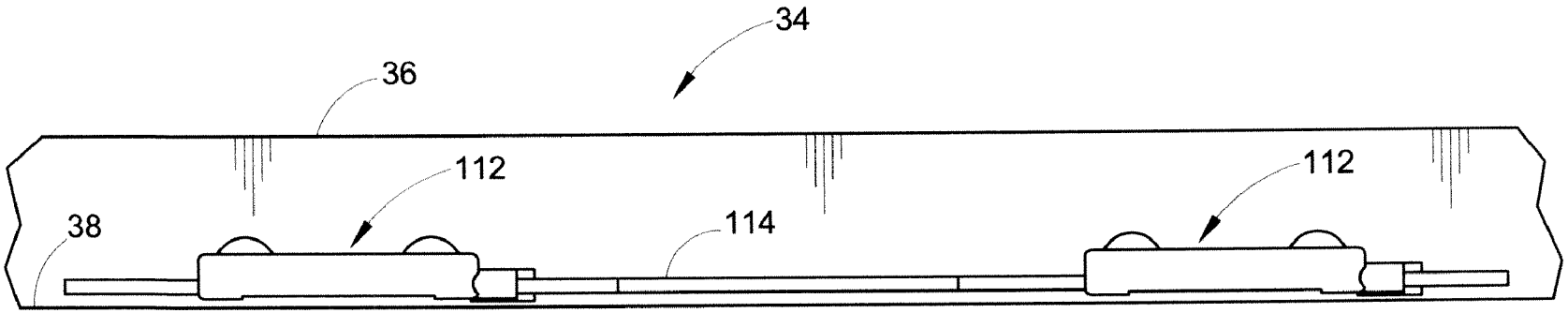
FIG. 8 is a side elevation view of the string light engine shown in FIG. 1 inside a sign.
Figure 9:
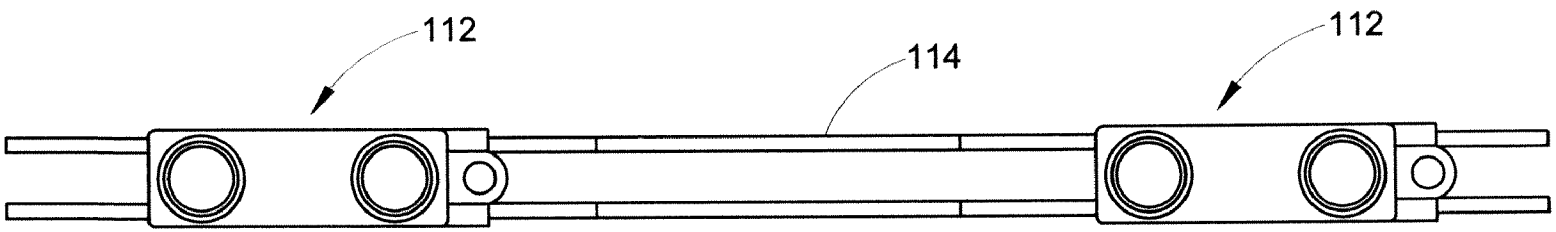
FIG. 9 is a top plan view of the string light engine shown in FIG. 1.

With reference to FIGS. 6 and 7, the depicted optical element 124 includes at least two refractive domes 140 connected by an integrally formed interconnecting portion 142. The domes 140 can also be provided as individual elements without any connecting portion therebetween. An opening 144 (only half of which is visible in FIGS. 6 and 7 since a cross-sectional view of the optical element 124 is shown) is provided in the interconnecting portion 142 between the domes 140. The opening 144 provides a space in which electrical components, e.g. resisters and the like, can be provided on the printed circuit board 126. The refractive domes 140 are found on the optical element 124, which can be an integrally molded plastic or glass piece, i.e. a one-piece unit.

FIG. 7 depicts a side elevation view of FIG. 6 and more clearly shows the refractive domes 140. Each dome 140 is a refractive element having a varying wall thickness. Axes 146 coincide with the direct, on-axis view axes of the LEDs 122 from which the off-axis angle β is measured. In this embodiment, the axes 146 are spaced 25 mm from one another although other spacings may be used. The on-axis wall thickness of each refractive dome 140 is less than the wall thickness at the off-axis angle β1 or β2 For the depicted optical element each dome 140 has a spherical outer profile, or outer surface, 148 and an ellipsoidal inner profile, or inner surface 152. For the depicted embodiment, a focal point of the ellipsoidal inner profile 152 coincides with a center of the respective LED 122 that cooperates with the refractive dome 140.

The refractive domes 140 are configured to cooperate with the respective LEDs 122 in a manner similar to the optical elements 54 and 56 shown in FIG. 3. In other words, the refractive domes 140 cooperate with a respective LED 122 to broaden the off-axis angle β1 (see FIG. 2) to a greater off-axis angle β2 (see FIG. 3). The domes 140 are designed so that the luminous intensity of light emanating from a respective LED 122 and redirected by the domes 140 is wider than if no refractive optic were used with the LEDs. The domes 140 and the entire optical element 124 can take alternative configurations to broaden the viewing angle of the LEDs with which it cooperates. For example, the domes can include faceted inner or outer surfaces that achieve the desired beam spreading characteristics described with reference to FIG. 3. Moreover, the refractive dome can be replaced by a reflective optical element that achieves the desired beam spreading characteristics described with reference to FIG. 3.

With reference back to FIG. 5, each LED module 112 can also include a reflective surface 160 disposed adjacent the LED 122. The reflective surface 160 reflects any light that is directed back toward the support 126 from the reflective domes 140 and redirects the light toward the refractive domes 140 which then refracts through the refractive domes onto the target plane. The reflective surface 160 does not cover the entire printed circuit board in the depicted embodiment. Instead, the reflective surface 160 has a surface area that is bounded by a respective dome 140. If desired, however, the entire first surface of the support can include the reflective surface.

The light engine has been described with reference to the particular embodiments. Modifications and alterations will occur to those skilled in the art upon reading and understanding the preceding detailed description. It is intended that the invention be construed as including all such modifications and alterations insofar as they come within the scope of the appended claims or the equivalents thereof.

The invention claimed is:

1. A light engine for illuminating a target plane at a defined uniformity, the light engine spaced from the target plane a distance D and comprising:

a plurality of LEDs arranged in adjacent rows spaced from one another by a distance W, each of the LEDs having an off-axis angle β1 defined by a half intensity boundary where luminous intensity of the LED on a plane is about half the luminous intensity on the plane at the direct on-axis view, wherein tan β1<(W/2)/D; and a plurality of optical elements each cooperating with a respective LED to broaden the off-axis angle β1 to an off-axis angle β2 wherein the half intensity boundary of one row of LEDs is in close proximity to the half intensity boundary of the adjacent row of LEDs at the target plane.

2. The light engine of claim 1, wherein the optical elements are refractive optical elements.

3. The light engine of claim 1, wherein the distance D is less than 5 inches.

4. The light engine of claim 3, wherein the distance D is less than 2 inches.

5. The light engine of claim 1, wherein the optical elements each comprise a domed-shaped refractive element having a varying wall thickness wherein an on-axis wall thickness is less than a wall thickness at the off-axis angle β2.

6. The light engine of claim 1 wherein the optical elements each comprise a domed-shaped refractive element having a spherical outer profile and an ellipsoidal inner profile.

7. The light engine of claim 6 wherein a focal point of the ellipsoidal inner profile coincides with the LED.

8. The light engine of claim 1 wherein the target plane comprises the face of a sign.

9. The light engine of claim 1, further comprising a plurality of supports and a reflective coating disposed on a first surface of the supports, each LED being mounted on the first surface of a respective support.

10. The light engine of claim 9, wherein the reflective coating is bounded by a refractive portion of a respective optical element.

11. A method for illuminating a sign comprising:

placing a plurality of electrically interconnected LED modules in a sign having a translucent cover, each LED module including an LED and an optical element cooperating the with LED, each LED having an off-axis angle β1 where luminous intensity of light emanating from the respective LED that is not redirected by the respective optical element is about half the luminous intensity of on-axis luminous intensity for the respective LED;

spacing each LED a distance D from the translucent cover;

arranging the LED modules in adjacent rows such that adjacent LEDs are spaced from one another a distance W, wherein tan β1<(W/2)/D; and illuminating the plurality of LEDs to generate a plurality of beam patterns on the translucent cover by redirecting light from each LED via the respective optical element to have off-axis angle β2 where luminous intensity of light emanating from the respective LED that is redirected by the respective optical element is about half the luminous intensity of on-axis luminous intensity for the respective LED and the respective optical element, wherein a first beam pattern on the target plane generated by the first LED in combination with a first optical element in the first row and bounded by the off-axis angle β2 overlaps or coincides with a second altered beam pattern on the target plane generated by the second LED in combination with a second optical element in the adjacent row and bounded by the off-axis angle β2.

12. The method of claim 11, wherein spacing each LED includes spacing each LED less than 30 mm from the translucent cover.

13. The method of claim 11, wherein illuminating the plurality of LEDs to generate a plurality of beam patterns includes refracting light generated by the LEDs.

14. The method of claim 13, wherein illuminating the plurality of LEDs to generate a plurality of beam patterns includes reflecting light generated by the LEDs.

15. The method of claim 11, wherein illuminating the plurality of LEDs to generate a plurality of beam patterns includes reflecting light generated by the LEDs.

16. A light engine comprising:

a plurality of electrically interconnected LED modules, the LED modules including a support having circuitry on a first surface;

an LED on the first surface of the support and electrically connected to the circuitry, the LED having a primary viewing angle;

a substantially dome-shaped refractive optical element covering the LED, the optical element having a generally spherical outer profile and substantially ellipsoidal inner profile to increase the primary viewing angle of the LED to provide an altered viewing angle that is greater than the primary viewing angle; and an overmolded housing substantially surrounding said support and contacting the optical element to seal the LED protecting the LED from ambient.

17. The light engine of claim 16, wherein each LED module includes at least two LEDs mounted on the support and the optical element includes at least two refractive domes connected by an integrally formed position, said integrally formed position defining an opening, each refractive dome cooperating with a respective LED.

18. The light engine of claim 17, wherein center to center spacing between the at least two LEDs is at least 25 mm.

19. The light engine of claim 17, wherein the refractive domes are found on an integrally molded plastic or glass piece.

20. The light engine of claim 16, wherein each LED module includes a reflective surface each disposed adjacent the LED.

21. A light engine for illuminating a target plane at a defined uniformity, said light engine spaced from the target plane a distance D and comprising:

a plurality of LEDs arranged in adjacent rows spaced from one another by a distance W, each of the LEDs having an off-axis angle β1 defined by a boundary where the luminous intensity of the LED is about half the intensity at the direct on-axis view, wherein tan β1<(W/2)/D; and a plurality of optical elements each cooperating with a respective LED to broaden the off-axis angle β1 to an off-axis angle β2 wherein tan β1 is about (W/2)/D.

* * * * *